United States Patent [19]

Wagenseil et al.

[11] 3,961,563

[45] June 8, 1976

[54] AXIAL PISTON MACHINE OF THE TYPE HAVING A TILTABLE CYLINDER BLOCK

[75] Inventors: Ludwig Wagenseil, Vohringen; Horst Deininger, Unterbalzheim, both of Germany

[73] Assignee: Hydromatik GmbH, Ulm, Danube, Germany

[22] Filed: Mar. 1, 1974

[21] Appl. No.: 447,225

[30] Foreign Application Priority Data

Mar. 19, 1973 Germany ..... 2313575

[52] U.S. Cl. ..... 91/506

[51] Int. Cl.[2] ..... F01B 13/04

[58] Field of Search ..... 91/491, 485, 504–506, 91/472; 92/12.2

[56] References Cited

UNITED STATES PATENTS 3,291,068 12/1966 Wiggermann ..... 91/505

FOREIGN PATENTS OR APPLICATIONS 1,066,423 2/1958 Germany ..... 92/12.2

721,559 1/1955 United Kingdom ..... 92/12.2

973,707 10/1964 United Kingdom ..... 91/507

*Primary Examiner*—William L. Freeh

*Attorney, Agent, or Firm*—Owen, Wickersham & Erickson

[57] ABSTRACT

An axial piston machine of the swashplate type has a movable valve plate at the piston end of the cylinder block, and displacement of the valve plate by a stroke control mechanism changes the tilt of the block. The valve plate has a front face subjected to the hydraulic end thrust of the cylinder block and a back face shaped conformably to and engaged with a cylindrical slideway in the machine body. The valve plate is guided against displacement in the direction of the axis of tilt by side surfaces of the machine body. At least one of the front and back faces is spherically arched to cause the hydraulic end thrust to urge the valve plate in a direction to keep one of its sides in continuous contact with a cooperating side face in the machine body. This prevents jamming and wedging of the valve plate in the slideway when the tilt of the cylinder block is adjusted, regardless of the existing load.

6 Claims, 5 Drawing Figures

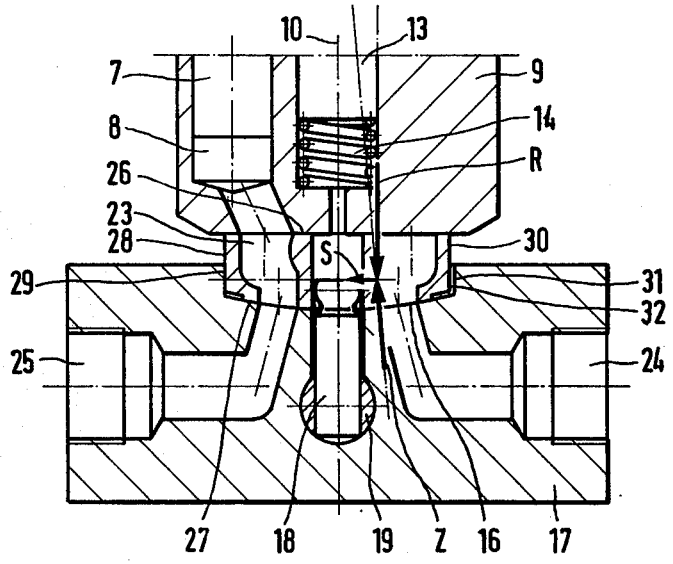
FIG. 4
FIG. 5
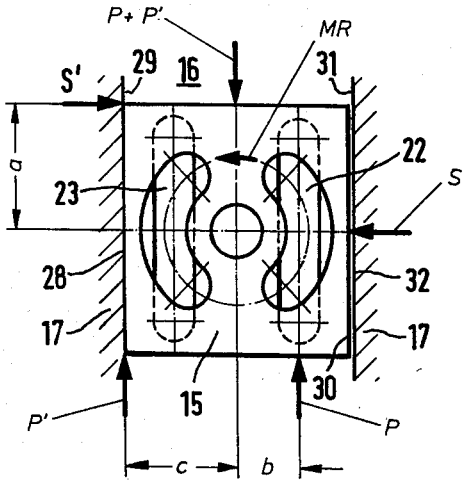

AXIAL PISTON MACHINE OF THE TYPE HAVING A TILTABLE CYLINDER BLOCK

BACKGROUND OF THE INVENTION

The invention relates to an axial piston machine. It relates particularly to such a machine having a tiltable cylinder block and a socket plate rotated in fixed bearings in the body of the machine by a drive shaft. Pistons are operatively coupled with the socket plate by ball and socket joints, and a valve plate is adapted to be displaced by stroke control mechanism in a cylindrical slideway which supports a conformably shaped back of the valve plate facing away from the cylinders. The sides of the valve plate are guided between side faces in the body of the machine which prevent displacement in the direction of the axis of tilt.

Axial piston machines of the specified kind are particularly suitable for compact self-contained transmissions, and in service they excel by their silence and freedom from vibration, even when the pressures and speeds of rotation are high.

In a machine of such a kind it has been proposed (German published Patent Specification No. 1,017,468) to provide the valve plate with surface areas and grooves where the hydraulic pressure is used to balance the tilting moment which acts on the cylinder block and which is transmitted thereby to the valve plate. Moreover, for stabilizing the valve plate its sides are provided with faces supported by rollers. It is a defect of this arrangement that whenever the cylinder block is tiltably moved, particularly when this is done under load, the forces acting on the valve plate may cause the latter to become misaligned and wedged between the lateral support means in the body of the machine.

In order to guard against this result it has been proposed (U.S. Pat. No. 3,233,555), in an axial piston machine having a cylindrical concave slideway, to support the sides of the valve plate by balls and through the agency of the balls to apply an additional lateral force which depends upon the magnitude of the end thrust to the sides of the valve plate so that the side faces of the plate are yieldingly held.

However, both the above mentioned arrangements have the drawback that either the valve plate must be of major dimensions or that supplementary means must be provided to prevent the valve plate, when the cylinder block is being tilted, from becoming jammed between the lateral guiding faces by the action of the torque which is applied to the valve plate by the rotating cylinder block.

In an axial piston machine having a tiltable cylinder block and an adjustable cradle it has been proposed (Swiss Patent Specification No. 325,587) to support the valve plate either in a cylindrical slideway or on a spherical surface inside the body of the machine. However, the arrangement described in this specification lacks means for laterally guiding the valve plate which can adjust itself freely on the spherical surface. The problem of jamming by wedging between lateral guide means does not therefore arise with such a non-guided valve plate construction.

SUMMARY OF THE INVENTION

The object of the present invention is the provision of a valve plate for a machine of the contemplated kind which is reliably guided, so that the risk of jamming or wedging is eliminated completely without the employment of additional means, and which can be of minimal overall size limited to what is absolutely essential for the passage of the hydraulic oil.

For achieving this object and according to the invention at least one of the two faces of the valve plate is spherically arched in such a way that the hydraulic end thrust urges the valve plate to keep one of its sides in contact with the cooperating guiding side face in the body of the machine. In the complete absence of additional means this arrangement ensures that the valve plate will be forced to maintain contact with one of the surfaces guiding its sides and thus prevented from wedging, irrespectively of the magnitude of the end thrust of the cylinder block and its angle of tilt.

In one embodiment of the invention the back of the valve plate being one of the two faces contemplated by the invention, and the conformably shaped slideway in the body of the machine are spherical surfaces about a center located on the axis of tilt. In the special case of the spherical surface being symmetrical with respect to the plane of tilt, the center of the spherical surface will coincide with the point of intersection of the axis of tilt and the axis of rotation of the cylinder block.

According to another feature of the invention the valve face may be convexly or concavely spherical about a center located on the axis of rotation of the cylinder block. This feature may be associated with the first above embodiment of the invention. All the embodiments definitely ensure without the provision of additional means that the valve plate will be kept in contact with one lateral guide face and thereby prevented from jamming and wedging in its ways when the tilt of the cylinder block is adjusted irrespectively of the existing load.

Embodiments of the invention will now be more particularly described with reference to the accompanying drawings.

BRIEF DESCRIPTION OF THE DRAWINGS

In the drawings:

FIG. 4 is a fragmentary section corresponding to that taken on the line I — I in FIG. 1, of a third embodiment; and FIG. 5 is a view of the working face of the valve plate for indicating the forces affecting the plate.

DESCRIPTION OF THE PREFERRED EMBODIMENTS

Figure 1:
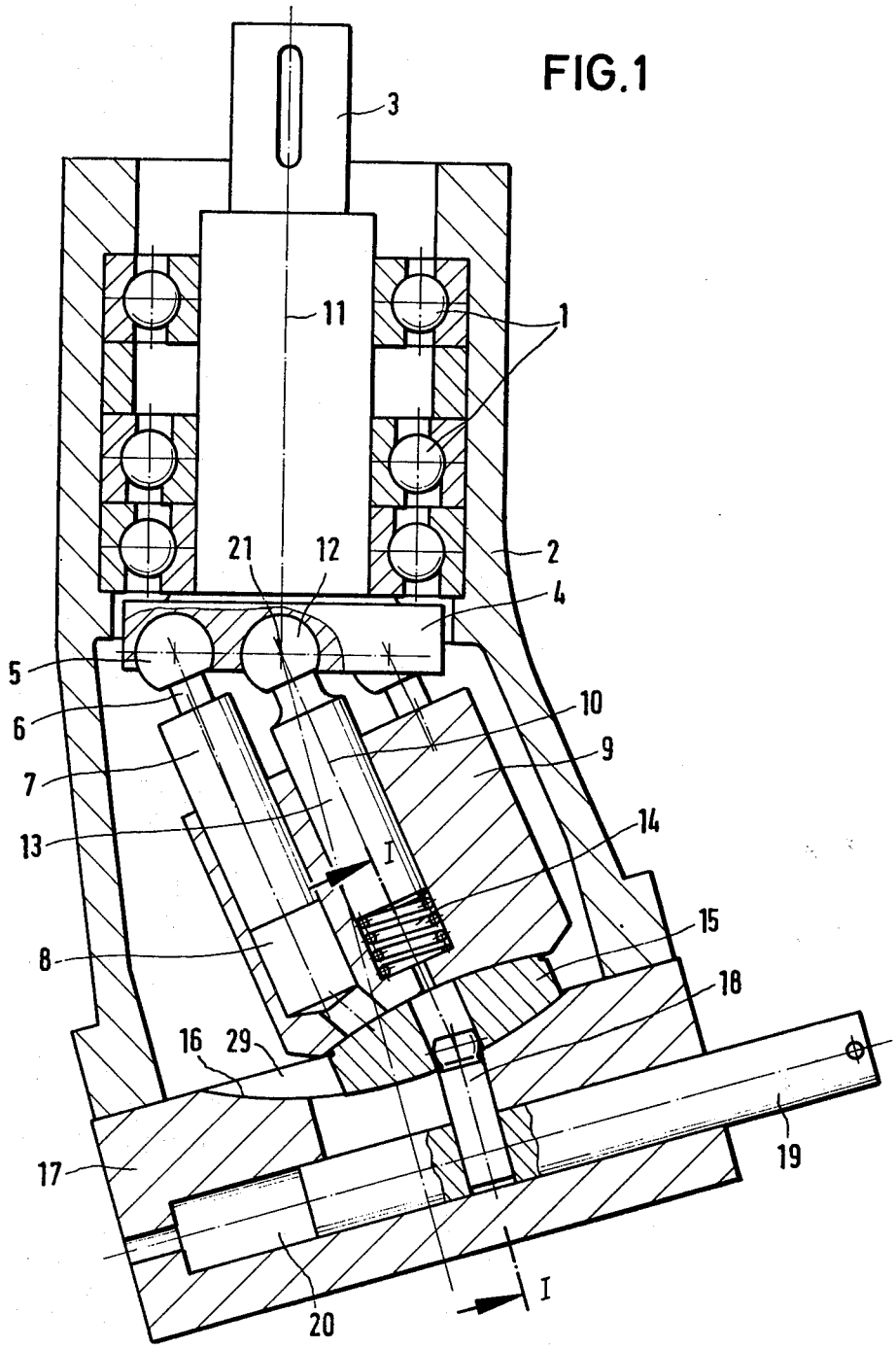
FIG. 1 is a schematic section of an axial piston pump constructed in accordance with an embodiment of the present invention and is taken in the tilting plane of the cylinder block.

The axial piston machine illustrated in FIG. 1 comprises a drive shaft 3 which is mounted in ball bearings 1 in a machine body 2 and integrally formed with a socket ring 4. The ball-headed ends 5 of the piston rods 6 of pistons 7 work in the sockets of the socket plate 4. The pistons 7 reciprocate in cylinders 8 of a cylinder block 9. The cylinder block 9 is rotated by the drive shaft 3 through the socket plate 4 and the pistons 7. The piston stroke depends upon the angle of tilt of the axis 10 of the cylinder block in relation to the axis of rotation 11 of the shaft 3. The cylinder block 9 is kept in central position by the ball head 12 of a pintle 13 working in a socket in the center of the socket plate 4. The cylinder block bears against a valve plate 15 which in turn is slidably supported by a cylindrical slideway 16 formed on a part 17 of the body of the machine, the cylinder block being kept in contact with the valve plate exclusively by the hydraulic end thrust when the machine is under load and otherwise only by a compression spring 14 interposed between the end of the pintle 13 and the cylinder block 9. The angle of tilt of the axis 10 of the cylinder block 9 in relation to the axis 11 of the drive shaft and hence the volume swept by the pistons 7 in the cylinder block 8 can be varied by means of a pin 18 which engages the valve plate 15, and which is firmly attached to a control rod 19, slidably contained in a transverse hole 20 in part 17 of the body of the machine. The control rod 19 is connected to stroke control mechanism adapted to move the control rod 19 to and fro and thereby by means of the pin 18 to displace the valve plate 15 in its cylindrical slideway 16 to swing the cylinder block 9 about its tilting axis 21. The valve plate 15 contains (reniform) ports 22 and 23 (see FIG. 5) for the admission and delivery of the hydraulic medium to and from the cylinder chambers 8 by connecting the chambers 8 to an inlet and outlet 24, 25 (see FIG. 2) in part 17 of the body of the machine in functional dependence upon the angular position of rotation of the cylinder block (FIGS. 2 to 5).

Figure 2:
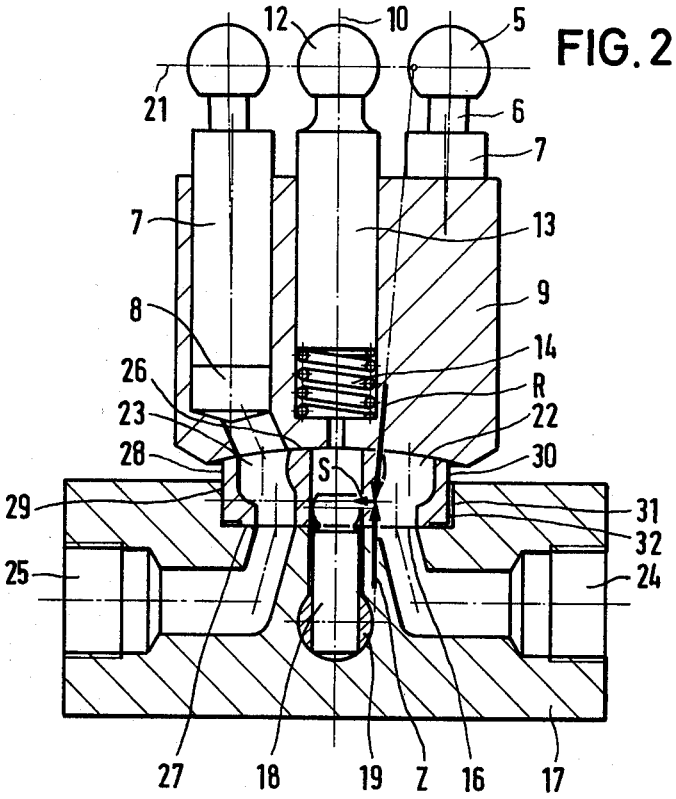
FIG. 2 is a fragmentary section taken on the line I — I in FIG. 1, of a first embodiment.

In the embodiment illustrated in FIGS. 1 and 2 the valve plate 15 has a spherically convex face 26. Because of this shape of its face the end thrust R (see FIG. 2) of the loaded cylinder block 9 bears on the port plate 15. This thrust R is opposed by the reactive thrust Z of the cylindrical slideway surface 16 which supports the back 27 of the valve plate 15. However, the two thrusts R and Z generate a resultant side thrust S (see FIG. 5) which urges the valve plate 15 to maintain contact between one of its sides 28 and a lateral guiding face 29 of part 17 of the body of the machine. On the opposite side of the valve plate a clearance 32 will therefore open up between this side 30 and the corresponding guiding face 31. The maintenance of contact between one of its sides 28 and the cooperating lateral guiding face 29 ensures that when the valve plate 15 is being displaced by the control rod 19 and its pin 18 it will not laterally tilt out of axial alignment with the axis of the guideway formed by the slideway 16 and the lateral guiding faces 29 and 31, and thus become wedged (cf. the later explanations with reference to FIG. 5).

Figure 3:
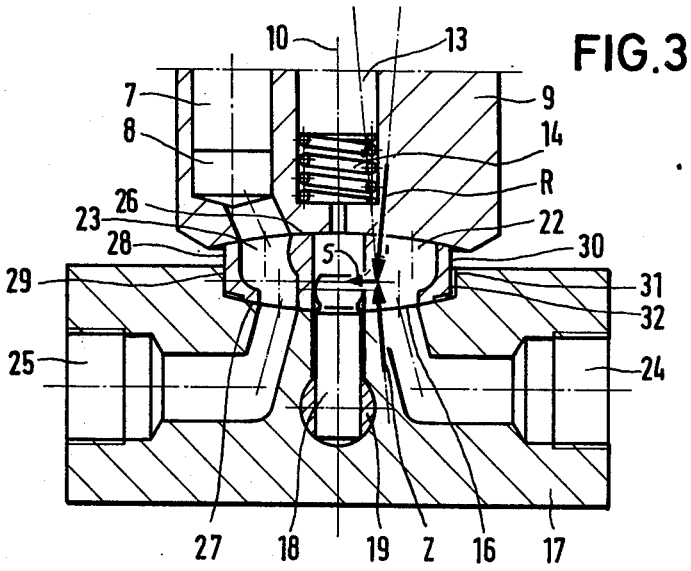
FIG. 3 is a fragmentary section taken on the line I — I in FIG. 1, of a second embodiment.

In the embodiment illustrated in FIGS. 1, 2 and 3 the face 26 of the valve plate 15 is spherically convex, whereas the back 27 of the valve plate 15 in conformity with the shape of the slideway 16 is either cylindrical (FIG. 2) or spherical (FIG. 3) about a center located on the axis of tilt 21. Otherwise like parts and the lines of action of corresponding forces are identified by the same reference numbers.

In the embodiment according to FIG. 4 the working face 26 of the valve plate 15 is flat and only its back 27 and the cooperating slideway 16 have surfaces that are spherically arched about a center on the axis of tilt 21. In the special case which applies to all the illustrated embodiments in which the amplitudes of the available angles of tilt are symmetrical the center of the spherical back 27 and of the spherical slideway 16 will be located at the intersection of the axis of tilt 21 with the axis of rotation 10 of the cylinder block. Otherwise like parts and corresponding forces in FIG. 4 are again identified by the same reference numbers as in the preceding drawings.

The relevant forces which arise as a result of the geometry of the arrangement according to the invention and which act on the valve plate 15 will be more readily understood by reference to FIG. 5. In this drawing $P + P'$ = adjusting force generated by the stroke control mechanism 18, 19.

$P$ = friction between the surfaces that are pressed together by the end thrust.

$P'$ = friction between the engaging side surfaces at 29,

$S$ = side thrust generated by the geometry of the valve face and/or of the back of the valve plate and the cooperating slideway, $s'$ = reactive thrust of the lateral guiding face 29 to the side thrust of the valve plate.

$MR$ = torque transmitted by the cylinder block 9 to the valve plate 15.

The valve plate 15 will apply itself smoothly to one of the side faces 29 if the moment of stability $$S.a = MR + (P.b - P'.c) .$$

Practical tests have confirmed that the side thrust S which is generated by the spherical geometry of the load bearing surfaces is always sufficient to ensure complete stability. Indeed the stability of the valve plate achieved by the geometry of the arrangement proposed by the present invention is high enough to render the provision of any additional guiding and locating means completely unnecessary, even during no-load operation. In the latter case the end thrust of the spring 14, which is regularly present, is quite adequate, and in arrangements according to the invention this thrust performs the dual function of ensuring that the cylinder block 9 will maintain contact with the valve plate 15 and that the valve plate 15 will maintain contact with the surface of the slideway 16.

We claim:

1. In an axial piston machine of the type having a machine body, a tiltable cylinder block, an axis of rotation extending through the cylinder block, a socket plate rotated in fixed bearings in the body by a drive shaft, an axis of tilt for the tiltable cylinder block extending through the socket plate, pistons operatively coupled with the socket plate by ball and socket joints in the socket plate, a valve plate at the piston end of the cylinder block adapted to be displaced by a stroke control mechanism and effective to tilt the block about the tilt axis on such displacement, a cylindrical slideway in the body for supporting the valve plate, said valve plate having a front face engaged with and subjected to the hydraulic end thrust at the piston end of the cylinder block and a back face shaped conformably to and engaged with the cylindrical slideway, and side faces in the body of the machine which guide the sides of the valve plate and prevent displacement of the valve plate in the direction of the axis of tilt, the improvement comprising, at least one of the front and back faces of the valve plate having a spherically arched curvature so related to the geometry of the hydraulic end thrusts exerted by the piston ends of the cylinder block on the valve plate as to cause the hydraulic end thrusts to generate an asymetrical laterally directed force component effective to maintain one of the sides of the valve plate in continuous lateral contact with a cooperating side face in the body of the machine without jamming and wedging of the valve plate in the slideway when the tilt of the cylinder block is adjusted regardless of the existing load and without additional guiding and locating means whereby the valve plate can be actuated by a small adjusting force whatever the hydraulic pressure in the cylinders.

2. The invention defined in claim 1 wherein the back face of the valve plate and the conformably shaped slideway in the body are spherical about a center located on the axis of tilt.

3. The invention defined in claim 2 wherein the center of the spherical back face and slideway coincides with the point of intersection of the axis of tilt and the axis of rotation of the cylinder block.

4. The invention defined in claim 1 wherein the front face of the valve plate is spherical about a center located on the axis of rotation of the cylinder block.

5. The invention defined in claim 4 wherein the front face is convexly spherical.

6. The invention defined in claim 4 wherein the face is concavely spherical.

* * * * *